United States Patent [19]

Green

[11] 4,024,951

[45] May 24, 1977

[54] CUP AND PACKAGE OF CUPS

[75] Inventor: John Foster Green, Wood Dale, Ill.

[73] Assignee: Compact Industries, Inc., Schaumburg, Ill.

[22] Filed: May 12, 1975

[21] Appl. No.: 576,464

[52] U.S. Cl. ..... 206/217; 206/519; 206/497; 229/1.5 B

[51] Int. Cl.[2] ..... B65D 62/00; B65D 85/72

[58] Field of Search ..... 206/217, 218, 520, 519, 206/497; 229/2.5, 1.5 B

[56] References Cited

UNITED STATES PATENTS

| | | | |
|---|---|---|---|
| 2,805,790 | 9/1957 | Smucker | 206/520 |
| 2,820,684 | 6/1974 | Harrison | 206/520 |
| 3,227,273 | 1/1966 | Syverson et al. | 206/217 |
| 3,696,987 | 10/1972 | Schuff et al. | 229/1.5 B |

*Primary Examiner*—William T. Dixson, Jr.
*Attorney, Agent, or Firm*—Fitch, Even, Tabin & Luedeka

[57] ABSTRACT

A plurality of stacked cups are nested and axially constrained against separation to assure cup-to-cup sealed engagement with portions of adjacent cups to prevent sifting of product from sealed enclosures between adjacent cups. The cups are thick walled, one piece molded plastic cups formed with integral radially inwardly projecting shoulder means spaced upwardly of the bottom wall of the cup. A marginal portion of an adjacent telescoped cup abuts and rests on the shoulder means to form the sealed enclosure for the deliquescent or hygroscopic material which can be reconstituted with the addition of water.

8 Claims, 3 Drawing Figures

CUP AND PACKAGE OF CUPS

This invention relates generally to the packaging of dehydrated, deliquescent or hygroscopic materials between adjacent cups in a stack. More specifically, it relates to a cup and a stack of cups which contain preselected amounts of material such as coffee, cocoa, oatmeal or the like, in each cup, and which cooperate to prevent sifting of such material between the stacked container walls and to retard the deliquescence of the material. Hereinafter, dehydrated material shall be understood to mean any dehydrated, deliquescent or hygroscopic material which can be reconstituted, rehydrated or otherwise prepared by the addition of water or similar liquid.

The prepackaging of dehydrated beverage or food materials between stacked cups is known to provide a quick and convenient means for dispensing such products, which may be easily reconstituted by the addition of hot water. For example, U.S. Pat. Nos. 3,289,385 and 3,227,273 illustrate a stack of cups and a method of packaging them, wherein the beverage or food material is preferably deposited in a cap seat located at the underside of the bottom of each cup and is enclosed by a similar cup nested thereover. The cap seat and the superimposed cup provided a generally sealed chamber when held together under axially applied force. A plastic overwrap and band secure the cups together and provide the axial force to hold the cups nested and provide a vapor barrier to lengthen the shelf-life of the product. The premeasured amount of material resides between adjacent cups and is dispensed by gravitational force when the lower cup of an upright stack is withdrawn from the stack. Upon the addition of hot water the material dissolves or otherwise absorbs the moisture, resulting in a ready meal or hot drink, but without requiring the extensive facilities or appliances that are usually required to provide such a product.

In the illustrated embodiments shown in U.S. Pat. Nos. 3,289,385 and 3,227,273, the cups are filled with the material while the cup is inverted and the cap seat facing upwardly. The deposited material substantially fills the cap seat cavity. Cups having such cap seat cavities are standard paper or plastic coated paper cups which have been formed by machines which combined a frusto-conical, peripheral wall and a bottom circular disk in a conventional and well-known manner to complete the cup having the cap seat. Coffee, hot chocolate and other materials have been successfully packaged in the inverted cap seat; and as disclosed in these patents, a sealed enclosure is formed when the next cup is telescoped to engage its bottom disk with the rim edge of the filled inverted cap seat. This cup-to-cup engagement results in an effective seal preventing the sifting of the material from the sealed enclosure. However, the conventional cap seats have a small capacity and are unable to hold sufficient quantities of breakfast cereals or other bulky materials.

The thin walled, one-piece plastic thermoformed cups have not been used in this type of package as they either lack a cap seat or have a small cap seat of insufficient depth to hold the necessary quantity of material. Moreover, for many hot products, such as coffee or hot chocolate, the thin walled plastic thermoformed cup cannot be used without a holder as it is too hot for a person to hold. Also the heat transfer from thin wall cups allows a rapid change in the temperature of the hot or cold liquid added and this may interfere with rehydration and ultimately makes the food less palatable to the consumer. For instance, very hot or very cold food or drinks prepared at a central location or kitchen may experience a considerable temperature change by the time they are delivered and ultimately consumed at a remote location.

Attempts have been made to fill the cups from the top and to merely telescope the cups together without a seal enclosure for the materials in cups and these have exhibited a number of deficiencies one of which is that the enclosed material can sift out of the containment and between the walls of the stacked containers. Not only does this sifting action cause a loss of product and thus deprive the ultimate consumer of the proper portion, but the material which sifts past the walls of the stacked containers also makes the package of stacked cups unsightly if a transparent overwrap is used. Further, the sifted material will adhere to the outer cup wall and will be sticky and dirty to the fingers of the user.

Just as the seal between adjacent cups is often not particle-tight, it is also often not vapor-retardent. Shelf-life is an important factor with any food or beverage product, and water vapor can seriously impair and shorten the shelf-life of a packaged stack of cups which contain portions of a dehydrated, deliquescent or hygroscopic product. An insecure seal, which allows portions of the food or beverage material to sift between the walls of adjacent cups, also shortens the shelf-life of the product by allowing exposure of it to the harmful effects of water vapor.

A further difficulty with known methods and cups used in the prepackaging of food or beverage products for quick dispensing is the limited volume of space available for storage of the necessary portion of beverage or food material. As is illustrated in U.S. Pat. No. 3,227,273, the space available for deposit of material in a cap seat is limited to that between the bottoms of closely stacked, adjacent cups. This may be sufficient for coffee, tea, or some other beverage product which requires only a small amount of dehydrated material in proportion to the amount of water used, but for bulkier foodstuff materials, such as saccharine or cream, or cereals such as oatmeal or Cream of Wheat, a much larger volume is necessary to contain sufficient food material for each serving.

Accordingly, one of the objects of this invention is to provide a cup and package of cups which can be used in the prepackaging of larger quantities of dehydrated food or beverage materials.

Another object of this invention is to provide a cup and a package of cups which contains dehydrated food or beverage product portions between adjacent cups and substantially prevents sifting of the material between adjacent cup walls.

Additional objects and advantages of the present invention are more particularly set forth in the following detailed description and in the accompanying drawings of which:

Figure 1:
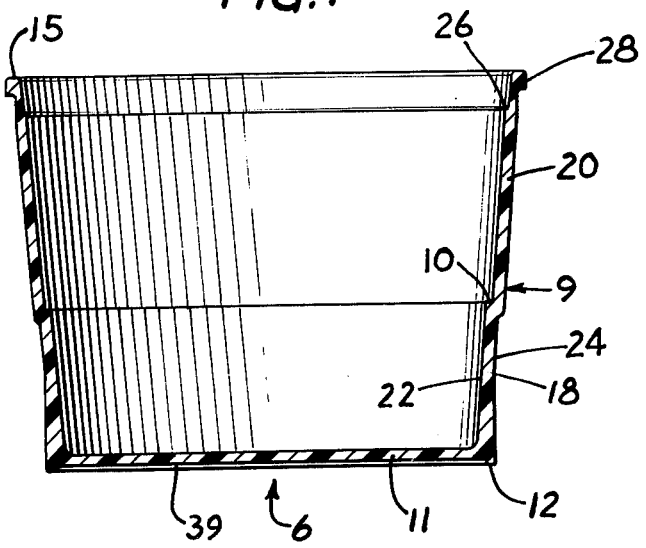
FIG. 1 is a vertical cross-sectional view of a cup or container constructed in accordance with the present invention.
Figure 2:
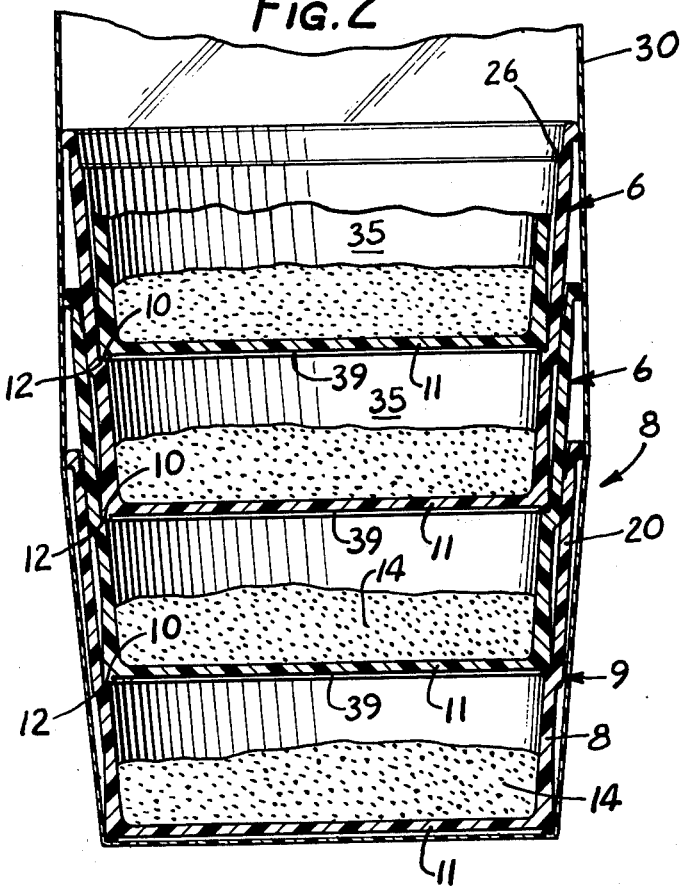
FIG. 2 is a vertical cross-sectional view of a stack of the cups or containers in accordance with FIG. 1 with portions of dehydrated, deliquescent or hygroscopic material between adjacent cups, and an overwrap to secure the package together.
Figure 3:
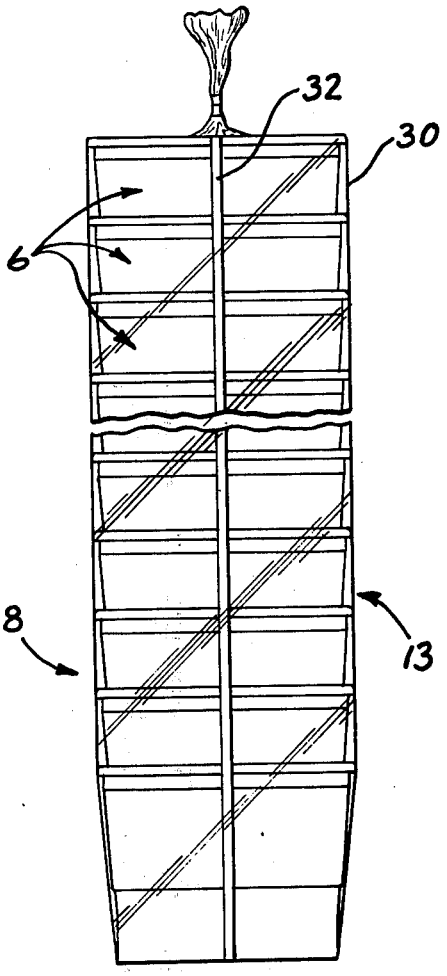
FIG. 3 is a perspective view of the package of stacked cups of FIG. 2.

As shown in the drawings for purposes of illustration, the invention is embodied in a package 8 of nested cups 6 with adjacent cups providing sealed enclosures 35 containing a portion-controlled quantity of dehydrated food or beverage product 14 for rehydration. Preferably, the cups are retained in the stacked condition by compressive axially directed force applied to the cups and with an outer moisture-resistant and sealed bag or cover 13 covering the stack. In the aforementioned patents, the plastic cover 13 was shrunk about the stack of cups to enclose the same and also to apply the axially directed force to the cups to prevent sifting of the material from the sealed enclosures formed at the cap seats of the nested cups. On the other hand, a restraining band 32 may encircle the stack and tightly bear on the cups to provide the axially directed force to the cups.

In accordance with the present invention, a larger quantity of material may be packaged within a cup 6 than has previously been packaged in the cap seat of the cups disclosed in the aforementioned patents while still obtaining a cup-to-cup, particle tight, sealed enclosure 35 between adjacent cups to prevent the sifting of the material from the enclosures 35 and onto the outer surface of the encircling walls 9 of the cups. This is achieved by providing a shoulder means 10 formed integral with its peripheral wall 9 and spaced substantially above a lower marginal portion 12 of the cup and projecting radially inwardly so that the lower marginal portion of the succeeding nested cup may rest thereon and provide a particle tight sealed enclosure 35 when resting on the shoulder means 10.

Also, as will be explained in greater detail, the preferred cup 6 is a one-piece, molded, thick-walled cup formed of expanded polystyrene having a wall thickness greatly in excess of the wall thickness of the conventional plastic coated paper or the thermo-formed plastic cups formed from plastic sheets. Particularly good results have been obtained with a highly glazed interior surface for the wall 9 which provides increased resistance to the transfer of heat allowing hot o cold drinks or foods to maintain their temperature longer which aids in rehydration and provides a longer retention time for serving or consuming.

The cups 6 are mass produced with the shoulder means 10 located at a predetermined height above the lower marginal portion to afford a standard volume at least several times in excess of the volume of a cap seat of a conventional cup. This provides sufficient volume for bulky foods or a large volume of a product 14 although the entire volume will not be needed for all of the various products. The internal shoulder means is so located and functions in a manner that should not be confused with a stacking ring. Stacking rings on adjacent cups allow the cups to telescope very closely to provide a minimum stack height with their bottom walls closely adjacent in contrast to the very high and large stack height for the cups 6 with the product 14 therein and with their bottom walls 11 spaced substantially from each other. Often the stacking rings are perforated or discontinuous to allow air flow between the cups and this would also allow product flow and sifting if one should attempt to use these stacking rings to enclose product.

More specifically, the illustrated cup or container 6 is of one piece, integral construction and generally of truncated conical shape, including an upstanding peripheral wall 9 and a horizontal bottom wall 11. Although a variety of materials may be used in accordance with the present invention, in the preferred embodiment the cup or container is made of molded expanded polystryrene or material with smilar characteristics. Distinctive from the uniform thin-wall plastic or paper cups often used in dispensing beverages, the polystyrene construction provides a thicker and better insulating cup wall, which may also have varying thickness. In a three inch diameter cup of expanded polystyrene, the peripheral wall 9 may be about 0.070 inches thick, and the bottom wall 11 about 0.065 inches thick, as compared to a normal thin wall cup thickness of 0.015 inches or less for the thermo-formed plastic cups. The surface of the polystyrene in the preferred embodiment is glazed in accordance with a process available from Continental Bondware Division of Continental Can Company, Inc., under the trademark CHINATHERM. This glazing increases the resistance of the cup to heat transfer through the walls, allowing hot or cold drinks or foods to maintain their temperature longer, which not only pleases the consumer, but also aids in rehydration which is often more effective at higher temperatures. Thinwall containers which allow the product temperature to drop-off rapidly after the addition of hot water may not provide as high a quality product, especially when it is a cereal or other bulky food product being rehydrated which requires a higher sustained temperature than other products. The glaze also helps increase the shelf-life of the package by retarding the passage of water vapor through the cup walls to the dehydrated material contained therein.

For containing a portion-size quantity of dehydrated beverage or foodstuff product 14, the cup 6 includes a lower portion or enclosure space defined between the shoulder means 10 and the upwardly facing side of the bottom wall 11 and circumscribed by a lower portion 18 of the peripheral wall 9. And to facilitate stacking, the cup has a larger upper portion spaced between the lip of the cup 15 and the shoulder means 10 and circumscribed by an upper portion 20 of the peripheral wall 9. The shoulder means 10 is a generally flat, radially extending ridge defined between the lower portion 18, and the larger diameter upper portion 20 of the peripheral wall. It is adapted for particle-tight abutment with the lower margin of portion 12 of a similar cup nested thereabove, thus providing the sealed enclosure 35 in the lower portion of the cup for the storage of a predetermined amount of dehydrated food or beverage material. Of course, the required spacing of the shoulder means above the bottom wall depends on the nature of the material to be reconstituted and the quantity required, but a spacing of 0.75 inches to 1.5 inches for an approximately three inch diameter cup has been found to be sufficient to provide the necessary space for most kinds of dehydrated beverage or food products.

The provision here for containing larger quantities of food product also cooperates with the preferred use of molded expanded polystyrene in the construction of the cups. These polystyrene cups are usually very light, and tend to adhere to adjacent cups in a stack. Thus, because they do not drop freely, they often cannot be used in automatic vending machines. However, with provisions for larger and heavier quantities of material in each cup, each will drop sufficiently freely to be automatically vended, even though constructed of lightweight polystyrene.

The lower portion 18 of the peripheral wall 9 is generally conical and has an inside surface 22 which tapers outwardly with a uniform slope from the bottom wall 11 to the shoulder means 10, and also has an outer surface 24 which is parallel to the inside surface in the region subjacent the shoulder means 10. To assure that the lower marginal portion 12 of each cup may abut the shoulder means of the cup nested therebelow, the outer surface 24 tapers to a diameter slightly less than the inside diameter of the upper portion 20 of the shoulder means. Below that point, the outer surface 24 is substantially vertical and extends below the bottom wall 11 to form a depending or marginal flange or rim portion 12 therearound. As noted earlier, this marginal portion or rim is adapted to form a particle-tight seal with the shoulder means 10 of another cup and thus provide a sealed enclosure 35 in the lower portion of the cup for the storage of dehydrated beverage or food material between the adjacent cups. By having the bottom marginal rim portion 12 of the upper cup engaging the shoulder means 10 of the lower cup, the undersurface 39 of the superimposed cup's bottom wall 11 only may be dusted by the product. Thus, the outer surface 24 of the cup peripheral wall 9 will not be dusted.

To accommodate a stacking and sealing arrangement between cups 6, the upper portion of each cup is outwardly inclined from the shoulder means 10, at which point the inside diameter of upper portion is slightly larger than the outside diameter at the marginal rim 12, to the lip 15. Although the angle of inclination may vary, depending on the circumstances and size or material of the cup, in the preferred embodiment, shown for the purposes of illustration only, the upper portion 20 tapers outwardly 5 ° from the vertical, which is the same as the taper of the inside surface 22 of the lower portion 18. With this construction, the lower portion 18 of each cup may be stacked or nested within the upper portion 20 of the cup therebelow, with the lower marginal rim 12 of the first or upper cup resting in sealable contact upon the shoulder means 10 of the second, or lower cup.

A flange 28 extends radially outwardly from the lip of the cup, and is of sufficient strength to provide a reinforcement around the lip and to cooperate in the dispensing of the cups by automatic vending machines which use a screw gear dispensing mechanism. In such a machine, the flange 28 is slidably engaged within the groove of the gear and the cup is lowered a predetermined amount upon each revolution of the gear, which is activated by a consumer's choice or selection from the machine. At a selected point along the gear, the cup is disengaged and dropped into the vending slot or opening in the machine. The exterior surface of the upper portion 20 is substantially vertical in the region of the flange 28 and thus converges toward the tapered inner surface to provide a wider flange which may engage the screw gear of the vending machine more positively.

For some uses, it is necessary that the cup 6 has a closure or cap to prevent spilling or waste. To accommodate the press-on type plastic closure well known in the art, the inner peripheral surface of the upper portion 20 tapers at a greater angle near the cup lip 15 than it does therebelow. In the illustrated embodiment the taper in the region near the lip is 6 °15′ from vertical as compared to 5 ° therebelow. The slight ledge 26 spaced below the lip of the cup and extending around the inside periphery is the line of demarcation between these surfaces of different taper. The increased angle of taper near the lip allows a plastic lid or closure to be more easily and snugly pressed into place over the top of the cup. After the cups 6 are stacked together with a portion of dehydrated food or beverage material contained within the particle-sealed volume between adjacent, nested cups, a restraining band 32 may be secured vertically about the stack in order to apply an axial force thereto and assure that the seal between the shoulder means 10 the marginal portion 12 of adjacent cups remains substantially particle-tight. The restraining band 32 may be of any suitable material which may be easily and securely fastened about the stack of cups.

Th overwrap or cover 30 is provided about the stack of cups to lengthen the shelf-life of the product by providing another barrier against water vapor transmission and may also supply additional axial force to the stack. The cover 30 may be constructed of a transparent plastic film, such as that sold under the trade name "Cryovac" by the Cryovac Division of W.R. Grace & Co. of Cedar Rapids, Iowa, or of some other suitable plastic or laminate material, such as Cryovac and Aluminum foil laminate, which can be heat-shrunk, or otherwise secured and sealed about the stack. A vacuum may also be applied by suitable means about the stack of cups before the closure 30 is sealed therearound to remove the air and the water vapor, and to better assure lasting product quality.

In summary, this invention provides a quick and convenient means for packaging and dispensing dehydrated beverage and food materials which may be reconstituted by the addition of hot or cold water or like material. The large sealed volume within the lower portion of each cup allows larger portions of food or beverage products to be stored than might otherwise be possible, and it also allows the use of bulkier dehydrated materials, such as cereals or oatmeal, than was possible in previously-known cups. The substantially particle-tight seal between adjacent cups prevents the loss of product sifting between the walls of adjacent cups and helps lengthen shelf-life by providing a water vapor-retardent barrier. The cups may be constructed of any suitable material, but glazed polystyrene has better heat retention properties than otherwise available with alternate materials, thus allowing the dehydrated product to be reconstituted with hotter, and more preferble water temperatures, and further has a higher resistance to vapor transmission, thus lengthening the life of the enclosed product during storage. The provision for storage of more and bulkier materials also cooperates to make cups constructed of polystyrene automatically vendable.

Although the description above has been made in terms of the preferred embodiment, it is not intended to disclaim obvious variations in construction or materials which can be made without departing from this invention.

Various of the features of the invention are set forth in the following claims.

What is claimed is:

1. A package of cups with deliquescent or hygroscopic material for use in the dispensing of beverages or food products comprising:

a plurality of cups telescoped together into a stack, each of said cups having a peripheral wall portion and a bottom wall defining an upwardly opening cup, shoulder means on said cups defined interiorly of said peripheral wall portion and integrally formed on the cups above their respective bottom walls, each of said cups further having a bottom annular marginal portion including an annular radially extending surface in substantially particle-sealed contact with said shoulder means of the cup nested therebelow and defining a substantially particle-sealed enclosure therebetween, a measured quantity of material provided within said sealed enclosure, said peripheral wall portion including a lower portion of substantially frusto-conical shape extending upwardly from said bottom wall to said shoulder means, said peripheral wall portion including an upper portion offset outwardly in a radial direction from said shoulder means to the upper end of the cup, said shoulder means located between said upper and lower portions, and means applying a compressive axial force to said stack maintaining said sealed contact between adjacent cups to limit entry of moisture and exiting of material from said sealed enclosures.

2. A package of cups in accordance with claim 1 in which said shoulder means is spaced 0.75 inches to 1.50 inches from said lower marginal portion of each of said cups and in which said marginal portion is a lower marginal rim for a cup.

3. A package of cups in accordance with claim 2 in which the cups are constructed of glazed foamed polystyrene with peripheral walls of at least 0.040 inch thickness to retard the transfer of heat and water vapor through the cup walls.

4. A package of cups in accordance with claim 1 in which said shoulder means is spaced 0.75 inches to 1.50 inches from said bottom of each of said cups and said peripheral wall thickness is in the range from about 0.040 to 0.075 inch.

5. A package of cups in accordance with claim 4 in which the cups are constructed of glazed foamed polystyrene to retard the transfer of heat and water vapor through the cup.

6. A one piece molded cup for storing a food product and a subsequent reception of hot or cold liquid comprising an upstanding peripheral wall portion and a bottom wall, said peripheral wall portion including a first wall portion and a second wall portion defining a stop shoulder with said first wall portion along the interior circumference of said peripheral wall portion, said first wall portion being radially offset at said shoulder portion relative to said second wall portion, said cup including a lower marginal portion including an annular corner portion of a wall thickness greater than the cup wall thickness adapted for substantially particle-sealed abutment with the stop shoulder when a second such cup is nested therewith, said stop shoulder spaced 0.75 to 1.5 inches above said bottom wall for providing a substantially particle-sealed volume when a second cup is nested therewith to engage said thickened cross-sectioned corner wall, said corner wall having a radial width corresponding to the radial width of said shoulder, a recessed central bottom undersurface surrounded by said corner wall for exposing to the food product, said volume being adapted to contain a deliquescent or hygroscopic product which may be reconstituted by the addition of water or like fluid, and said cup further being constructed of glazed, foamed polystyrene of at least 0.040 wall thickness to retard the transfer of water vapor and heat through said cup.

7. A package of cups with deliquescent or hygroscopic material for use in the dispensing of beverages or food products comprising:

a plurality of cups telescoped together into a stack, each of said cups having a peripheral wall portion and a bottom wall defining an upwardly opening cup, shoulder means on said cups defined interiorly of said peripheral wall portion and integrally formed on the cups above their respective bottom walls, each of said cups further having a marginal portion in substantially particle-sealed contact with said shoulder means of the cup nested therebelow and defining a substantially particle-sealed enclosure therebetween, a measured quantity of material provided within said sealed enclosure, and means external to said cups applying a force to said stack and maintaining said sealed contact between adjacent cups and limiting entry of moisture and exiting of material from said sealed enclosures, the bottom wall of one cup being spaced from the bottonm wall of an adjacent nested cup by a distance of about 0.75 inches to 1.5 inches to hold a substantial quantity of said material in said enclosures.

8. A package of cups with deliquescent or hygroscopic material for use in the dispensing of beverages or food products comprising:

a plurality of cups of molded plastic material telescoped together into a stack, each of said cups having a peripheral wall portion and a bottom wall defining an upwardly opening cup, shoulder means on said cups defined interiorly of said peripheral wall portion and integrally formed on the cups above their respective bottom walls, each of said cups further having a marginal portion in substantially particle-sealed contact with said shoulder means of the cup nested therebelow and defining a substantially particle-sealed enclosure therebetween, a measured quantity of material provided within said sealed enclosure, means applying a compressive axially directed force to said stack and maintaining said sealed contact between adjacent cups and limiting entry of moisture and exiting of the material from said sealed enclosures, said shoulder means including a continuous annular surface projecting radially inwardly from said peripheral side wall, a radially downwardly and inwardly projecting rim wall formed on the radially outer portion of the cup bottom wall in sealed surface to surface contact with said annular surface of said shoulder means, a thickened cross-sectional corner wall joining said peripheral side wall to said bottom wall and adding strength at said rim wall for transmitting the said axially directed force from cup to cup, and a recessed undersurface on said bottom wall of each container spaced upwardly and radially inwardly of said rim wall surface for contact by the quantity of material.

* * * * *